US011605366B2

(12) United States Patent
Bennett

(10) Patent No.: US 11,605,366 B2
(45) Date of Patent: Mar. 14, 2023

(54) LCC (LOW COST CONTROLLERLESS) GRAPHICS PROCESSING

(71) Applicant: Microchip Technology Incorporated, Chandler, AZ (US)

(72) Inventor: Matthew John Bennett, Jonestown, TX (US)

(73) Assignee: Microchip Technology Incorporated, Chandler, AZ (US)

( * ) Notice: Subject to any disclaimer, the term of this patent is extended or adjusted under 35 U.S.C. 154(b) by 0 days.

(21) Appl. No.: 17/463,979

(22) Filed: Sep. 1, 2021

(65) Prior Publication Data

US 2022/0076647 A1 Mar. 10, 2022

Related U.S. Application Data

(60) Provisional application No. 63/076,413, filed on Sep. 10, 2020.

(51) Int. Cl.
*G09G 5/395* (2006.01)
*G09G 5/36* (2006.01)

(52) U.S. Cl.
CPC ..... *G09G 5/395* (2013.01); *G09G 5/363* (2013.01); *G09G 2360/18* (2013.01)

(58) Field of Classification Search
CPC .... G09G 5/399; G09G 2340/02; G09G 5/395; G09G 5/363; G09G 5/393; G09G 2360/12; G09G 2360/18; G06T 1/60; H04N 1/32491
See application file for complete search history.

(56) References Cited

U.S. PATENT DOCUMENTS

| | | | | |
|---|---|---|---|---|
| 6,359,625 | B1 | 3/2002 | Perego | 345/555 |
| 2007/0002059 | A1 | 1/2007 | Booth et al. | 345/505 |
| 2019/0392546 | A1* | 12/2019 | Flordal | G06T 1/60 |

OTHER PUBLICATIONS

International Search Report and Written Opinion, Application No. PCT/US2021/049613, 16 pages, dated Nov. 29, 2021.

* cited by examiner

*Primary Examiner* — Hau H Nguyen
(74) *Attorney, Agent, or Firm* — Slayden Grubert Beard PLLC

(57) ABSTRACT

An apparatus includes a graphics driver circuit and a graphics engine circuit. The graphics engine circuit is configured to determine graphics data to be output to a display and to render the graphics data to a buffer. The graphics driver circuit is configured to output the buffer to the display. The graphics engine circuit is further configured to, while the graphics driver circuit is outputting the first buffer to the display, encode the first graphics data into another buffer, and to signal the graphics driver circuit to output the other buffer to the display.

16 Claims, 4 Drawing Sheets

LCC (LOW COST CONTROLLERLESS) GRAPHICS PROCESSING

RELATED APPLICATION

This application claims priority to commonly owned U.S. Provisional Patent Application No. 63/076,413 filed Sep. 10, 2020, the entire contents of which are hereby incorporated by reference for all purposes.

FIELD OF THE INVENTION

The present disclosure relates to graphics processing and, more particularly, to double buffering in a Low Cost Controllerless (LCC) graphics design and processing system.

BACKGROUND

In graphics processing, double-buffering may be used. In double buffering, a first buffer may be used to output a frame of data to a graphics screen, while a frame of data in a second buffer is updated. Upon a determined event, the second buffer is output to the graphics screen to replace the contents of the first buffer output to the graphics screen. A new buffer may be allocated to create additional updates. Double-buffering may be used to reduce stutter, tearing, and other artifacts in generating a graphical display. Computer monitors often redraw a visible frame at, for example, 60 times a second. An update from one frame to another frame may be visible momentarily as a horizontal divider between the "new" image and the un-redrawn "old" image, known as tearing.

A software implementation of double buffering includes a "back buffer" and a "front buffer". The back buffer may be a region in system RAM while the front buffer may be in video RAM. Double buffering may include storing all drawing operations results in the back buffer. When all drawing operations are considered complete, the whole region (or only the changed portion) is copied into the front buffer. This copying is usually synchronized with the display's horizontal or vertical synchronization in order to avoid tearing. Software implementations of double buffering necessarily require more memory and CPU time than single buffering because of the system memory allocated for the back buffer, the time for the copy operation, and the time waiting for synchronization.

Inventors of embodiments of the present disclosure have discovered that maintaining two complete buffers for frames of data may be prohibitively expensive in terms of memory. For example, in microcontroller applications with an embedded display screen, the memory necessary to maintain the two complete buffers may exceed the total on-board memory within the microcontroller. External memory may be used, but this incurs additional issues of speed and cost. Accordingly, embodiments of the present disclosure address one or more of these issues by performing a modified form of double-buffering by maintaining a main frame buffer and providing a smaller, encoded frame buffer.

DETAILED DESCRIPTION

Figure 1:
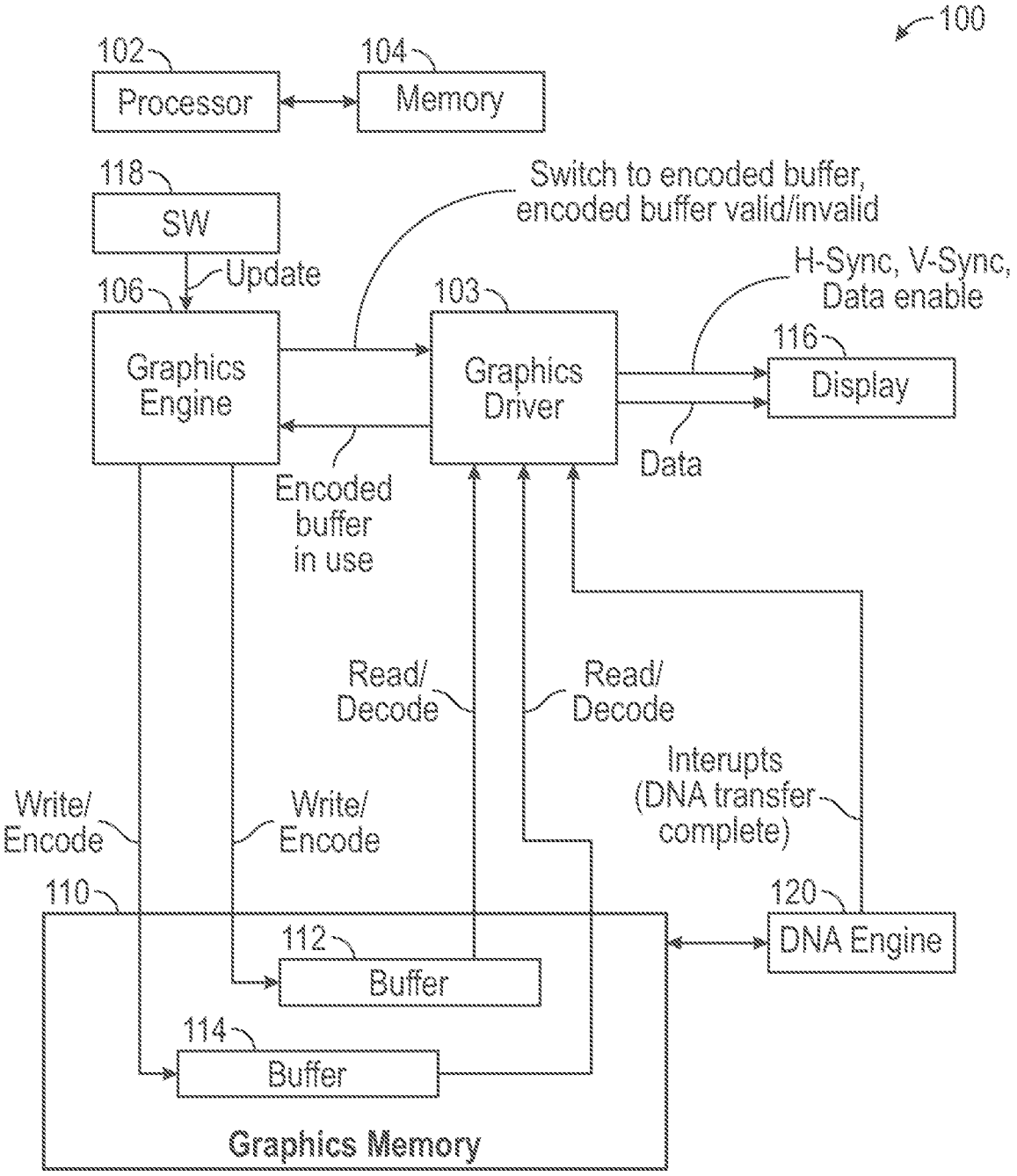
FIG. 1 is an illustration of an LCC graphics design and processing system, according to embodiments of the present disclosure.

Embodiments of the present disclosure include an apparatus. The apparatus may be implemented within any suitable system or context, such as in a graphics processor, system, graphics card, computer, laptop, server, mobile device, smartphone, die, motherboard, or any other suitable electronic device. The device may include a graphics engine circuit and a graphics driver circuit. The graphics engine circuit and the graphics driver circuit may be implemented in any suitable manner, such as by analog circuitry, digital circuitry, instructions for execution by a processor, or any suitable combination thereof.

In combination with any of the above embodiments, the graphics engine circuit may be configured to render data to be displayed on a display. This rendered data may be based upon data or an update signal received thereto. The rendered data or update signal may be generated by software. The graphics engine circuit may be configured to render the information for display by converting objects to pixel data in frame buffers in memory graphics memory. The graphics driver circuit may be configured to take such rendered data and copy or output such rendered data to display. The graphics driver circuit may be configured to copy contents of buffers to display, using any suitable set of signals, such as a vertical sync signal (v-sync), a horizontal sync signal (h-sync), a data enable signal, and signals for the data itself. The graphics driver circuit may perform the actual copying through DMA.

In combination with any of the above embodiments, the graphics engine circuit may be configured to determine graphics data to be output to a display, and to render the graphics data to a buffer. The graphics data may be generated by, for example, software running on a system including the apparatus or the apparatus. The graphics data may be, for example, a frame of information or a line of a frame. The graphics driver circuit may be configured to output the buffer to the display. The graphics engine circuit may be configured to, while the graphics driver circuit is outputting the buffer to the display, encode the graphics data into another buffer, and signal the graphics driver circuit to output the other buffer to the display.

In combination with any of the above embodiments, the graphics driver circuit may be configured to, upon reception of a signal from the graphics engine circuit to output the other buffer to the display, cease output of contents of the buffer to the display, decode contents of the other buffer, and output decoded contents of the other buffer to the display.

In combination with any of the above embodiments, the graphics driver circuit may be configured to determine that the other buffer is in use to output contents to the display. The graphics driver circuit may be configured to, based on the determination that the other buffer is in use to output contents to the display, determine that a signal has been received to indicate that the contents of the other buffer are not to be used. The graphics driver circuit may be configured to, based on the determination that the signal has been received to indicate that contents of the other buffer are not to be used, output the buffer to the display.

In combination with any of the above embodiments, the graphics driver circuit may be configured to, upon reception of a signal from the graphics engine circuit to output the other buffer to the display, determine whether the other buffer includes valid data. The graphics driver circuit may be configured to, based on a determination that the other buffer does not include valid data, continue to output the buffer to the display.

In combination with any of the above embodiments, the graphics engine circuit may be configured to determine additional graphics data to be output to the display, determine whether the other buffer is in use by the graphics driver circuit, and, based on a determination that the other buffer is in use by the graphics driver circuit, render the additional graphics data to the buffer.

In combination with any of the above embodiments, the graphics engine circuit may be configured to, after rendering the additional graphics data to the buffer, signal that contents of the other buffer are invalid.

In combination with any of the above embodiments, the graphics engine circuit may be configured to determine additional graphics data to be output to the display, determine whether the other buffer is in use by the graphics driver circuit, and, based on a determination that the other buffer is not in use by the graphics driver circuit, determine whether contents of the other buffer are signaled by the graphics engine circuit as valid.

In combination with any of the above embodiments, the graphics engine circuit may be configured to, based on a determination that contents of the other buffer are signaled as valid, signal to the graphics driver circuit to output the other buffer to the display.

In combination with any of the above embodiments, the graphics engine circuit may be configured to, based on a determination that contents of the other buffer are not signaled as valid, render the graphics data to the other buffer.

In combination with any of the above embodiments, the graphics engine circuit may be configured to signal that the contents of the other buffer are invalid. The graphics engine circuit may signal that the contents of the other buffer are invalid to the graphics driver circuit.

FIG. 1 is an illustration of an LCC graphics design and processing system 100, according to embodiments of the present disclosure.

System 100 may include a processor 102 communicatively coupled to a memory 104. Memory 104 may include instructions that, when loaded and executed by processor 102, cause various functionality of system 100 to be executed. For example, software 118 may comprise instructions in memory that are executed by processor 102. This may include execution of, for example, software, firmware, scripts, or other elements. The execution of, for example, software 118, may cause data that is to be displayed on a display 116. Display 116 may be implemented by any suitable graphical display, such as a monitor. For example, a user interface for software 118 may be displayed through execution of software 118. The execution may further cause changes to such a display. For example, pressing a button in the user interface may cause further graphical changes to be made to what is shown on display 116. System 100 may include any suitable number and kind of elements to process data that is to be displayed on display 116. For example, system 100 may include a graphics engine circuit 106 and a graphics driver circuit 108. Moreover, system 100 may include a direct memory access (DMA) engine circuit 120.

Graphics engine circuit 106, graphics driver circuit 108, and DMA engine circuit 120 may be implemented in any suitable manner. For example, graphics engine circuit 106, graphics driver circuit 108, and DMA engine circuit 120 may be implemented by analog circuitry, digital circuitry, instructions (such as those stored in a memory such as memory 104) for execution by a processor (such as processor 102), or any suitable combination thereof.

Graphics engine circuit 106 may be configured to render data to be displayed on display 116. This rendered data may be based upon data or an update signal received thereto. The rendered data or update signal may be generated by software 118. Graphics engine circuit 106 may be configured to render the information for display 116 by converting objects to pixel data in frame buffers in memory graphics memory 110, discussed in more detail below. Graphics driver circuit 108 may be configured to take such rendered data and copy or output such rendered data to display 116. Graphics driver circuit 108 may be a low cost controllerless (LCC) graphics driver. An LCC graphics driver may include any suitable software to eliminate graphics controller hardware, typically using DMA. This solution may be time sensitive as display 116 may require continuous data input. Graphics engine circuit 106 and graphics driver circuit 108, when simultaneously using the same buffer, give poor visual performance. Double buffering is a possible solution to this problem, wherein there is a buffer for rendering that is populated by graphics engine circuit 106, and another buffer for graphics driver circuit 108 to read and then to output data therein to display 116. The buffers are switched when the process is complete.

Consequently, graphics engine circuit 106 may be configured to provide rendered data to graphics driver circuit 108 through a double buffer. For example, graphics engine circuit 106 may write data as it is rendered to buffer 112. Graphics engine circuit 106 may be configured to write data to buffer 112 and, when it is finished writing such data as a display frame, and upon any suitable further criteria, graphics engine circuit 106 may issue a suitable signal to graphics driver circuit 108 that the contents of buffer 112 can be copied to display 116.

Graphics driver circuit 108 may be configured to copy contents of buffer 112 to display 116, using any suitable set of signals, such as a vertical sync signal (v-sync), a horizontal sync signal (h-sync), a data enable signal, and signals for the data itself. Graphics driver circuit 108 may perform the actual copying through DMA through use of DMA engine 120. Graphics driver circuit 108 may send signals to DMA engine 120 to begin performance of such copying. Upon completion of the writing of data to display 116 from buffer 112, DMA engine 120 may be configured to issue interrupts or other suitable signals that the DMA transfer is complete. The signals may indicate from which buffer the transfer was made.

Meanwhile, graphics engine circuit 106 may be configured to allocate a new buffer, such as buffer 114, to write further rendered data for another frame update subsequent to the data provided to the first buffer 112. This allocation, and subsequent rendering of data thereof, may be performed while graphics driver circuit 108 is updating buffer 112 to display 116. Upon an interrupt from DMA engine 120 indicating that buffer 112 has finished being transferred, graphics driver circuit 108 may be configured to begin transferring buffer 114 through use of DMA engine 120 to display 116. While such a transfer is occurring, graphics engine circuit 106 may be configured to allocate yet another new buffer (not shown) based on a further update for display 116.

Buffer 112 and buffer 114 may be located in, for example, a memory such as graphics memory 110. Graphics memory 110 may be a part of or separate from memory 104.

Double buffering frames for display 116 is a technique used to improve visible graphics performance, providing a smooth and "glitch-less" experience for the user. However, double buffering may require two copies of frames—stored respectively in buffers 112, 114. For a device of system 100, such as a MICROCHIP PIC32MZ2048EF microcontroller with 512K of memory and a 272×480 display with 16 bits per pixel, 261,120 bytes may be required per buffer. Two such buffers may require more memory than is available.

In one embodiment, when a new frame is rendered by graphics engine circuit 106, the new frame may be immediately displayed by graphics driver circuit 108 directly from the frame buffer while graphics engine circuit 106 encodes the same frame as a smaller copy. For example, after buffer 112 is filled with a frame of data by graphics engine circuit 106, graphics driver circuit 108 may display the data of buffer 112 to display 116. Meanwhile, graphics engine circuit 106 may render the same frame of data, but encoded, to buffer 114. While the data to be encoded and written to buffer 114 could be immediately encoded and written, the task could be enqueued or pipelined. Any suitable encoding of the frame may be used. In one embodiment, an encoding method that can be rapidly decoded, such as run-length encoding, may be used. In a single 32 bit word, the 16 bits of color information are stored with a 16-bit run length.

For subsequent display of the same information to display 116, graphics driver circuit 108 may read data from the original buffer 112 or instead from the newly encoded data in buffer 114. The newly encoded data in buffer 114 contains the same data that was written to buffer 112, only encoded. When using encoded data in buffer 114, graphics driver circuit 108 may be configured to decode the contents of buffer 114 before displaying them to display 116. Graphics driver circuit 108 may be configured to decode these contents in a just-in-time or real-time manner. Thus, the encoding should allow for fast decoding, which may be accomplished by, for example and discussed above, run-length encoding. When graphics driver circuit 108 switches to use of buffer 114, buffer 112 may be deallocated, thus saving usage of memory. Moreover, buffer 112 may be reused for new frame information as needed by graphics engine 106, or a new buffer (not shown) may be reallocated when new frame information is to be displayed to display 116.

Thus, one of buffer 112 and buffer 114 may be designated as a main frame buffer, including the full data contents of a frame of data to be displayed to display 116. The other of buffer 112 and buffer 114 may be designated as an encoded frame buffer, wherein the full data contents of the frame of data are not stored therein, but instead an encoded version of such a frame is stored. Moreover, the designation of which of buffers 112, 114 is a main frame buffer and which is an encoded frame buffer may persist as necessary or change as necessary, depending upon the implementation. For example, buffer 112 may be the main frame buffer and buffer 114 may be the encoded frame buffer. Graphics engine circuit 106 may populate buffer 112 and begin populating buffer 114. Graphics driver circuit 108 may read data from buffer 112. When new information is to be displayed to display 116, graphics engine circuit 106 may signal this to graphics driver circuit 108 to begin using buffer 114. Graphics driver circuit 108 may begin decoding and displaying data from buffer 114 while buffer 112 is loaded with new information by graphics engine circuit 106. Graphics engine circuit 106 may signal to graphics driver circuit 108 when data is ready in buffer 112, and graphics driver circuit 108 may switch and begin displaying data from buffer 112. Meanwhile, graphics engine circuit 106 may begin populating buffer 114 with encoded versions of the same data. Thus, buffer 112 may persistently be the main frame buffer while buffer 114 may persistently be the encoded frame buffer. In such a case, graphics engine circuit 106 may maintain a status of which of buffers 112, 114 is to be used by graphics driver circuit 108 and whether the data of buffers 112, 114 is valid to be displayed.

Moreover, graphics engine circuit 106 may provide the status of whether graphics driver circuit 108 is to read data from buffer 112 or instead from buffer 114 in any suitable manner. Graphics engine circuit 106 may provide a signal to graphics driver circuit 108 that graphics driver circuit 108 is to switch from reading data from buffer 112 and instead read data from buffer 114. Moreover, graphics engine circuit 106 may provide a signal to graphics driver circuit 108 that data has been successfully encoded and is available in buffer 114 to be used. This may be referred to as marking buffer 114 as valid (wherein data has been successfully encoded and is available in buffer 114) or invalid (wherein data in buffer 114 is no longer to be used). Any suitable mechanism may be used to provide such signals between graphics engine circuit 106 and graphics driver circuit 108, such as a bus, register value, bit in memory, or other suitable signal.

Thus, graphics driver circuit 108 may continue to read directly from buffer 112 until the contents for display 116 are set to change by software 118. Before such a time when the contents for display 116 are set to change, the same data may be repeatedly displayed on display 116, as discussed above.

When new data is generated by software 118, graphics engine circuit 106 may signal to graphics driver circuit 108 to switch to using buffer 114. Thus, graphics driver circuit 108 may switch to using encoded data in buffer 114. This may then allow graphics engine circuit 106 to directly modify the contents of buffer 112 without introducing anomalies that an end user perceiving display 116 would notice. Graphics driver circuit 108 may be configured to actively decode the data of buffer 114 a line at a time. This decoding may be performed during an interrupt, allowing the main tasks of the processor to continue.

To switch to using encoded data in buffer 114, system 100 may wait until the display of the current frame in display 116 is complete. This may be indicated by, for example, the completion of a v-sync interval. The decoding and displaying of data from buffer 114 may be performed a line at a time. One line of buffer 114 may be actively displayed on display 116 while the next line of buffer 114 is decoded by graphics driver circuit 108.

The life cycle of a display line as generated by graphics driver 108 and displayed on display 116 may have four intervals, each driven by a separate DMA channel. These intervals may include intervals designated as "back porch", "horizontal sync", "visible", and "front porch." The life cycle of a display line may itself repeat within a larger cycle defined by a vertical sync, wherein an entire frame of lines is displayed through respective display line life cycles. The completion of a given interval may trigger an interrupt to graphics driver circuit 108. Graphics driver circuit 108 may be configured to issue particular signals to display 116 in response to these interrupts to further the display process of a given display line.

The "front porch" interval is an interval period between the end of picture information and the start of a vertical or horizontal sync pulse. During this interval, the output levels to affected pixels of display 116 are for black or blanking levels to clear any signal level that remains before a vertical or horizontal sync pulse occurs.

The "horizontal sync" interval is an interval wherein the data to be displayed on display 116 for the given line is output (though not yet displayed) to display 116.

The "visible" interval is an interval wherein the data is displayed on display 116. The data that is displayed must not change during the "visible" interval.

The "back porch" interval is the duration between the end of a vertical or horizontal pulse and the start of the next line with video information. During this interval, beam scanning for a reverse direction (such as right to left) may be performed to start a new line.

Using DMA interrupts through DMA engine 120, the completion of the "front porch" triggers the "horizontal sync", the completion of the "horizontal sync" triggers the "back porch," the completion of the "back porch" triggers the "visible," and completion of the "visible" triggers the "front porch," restarting the cycle.

Figure 2:
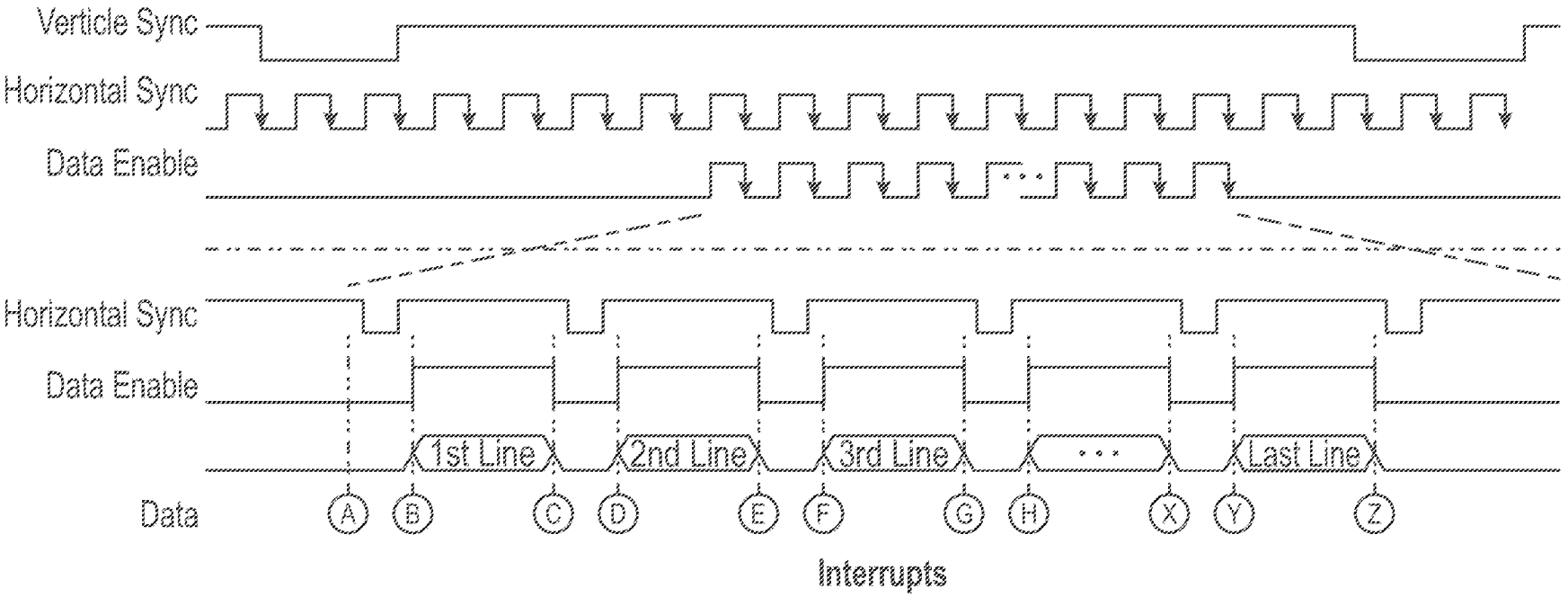
FIG. 2 is an illustration of timing diagrams for operation of the system, according to embodiments of the present disclosure.

FIG. 2 is an illustration of timing diagrams for operation of system 100, according to embodiments of the present disclosure. In particular, FIG. 2 illustrates timing diagrams of output of control signals by graphics driver circuit 108 to display 116. Furthermore, FIG. 2 illustrates interrupts generated by DMA engine 120 for graphics driver circuit 108.

Illustrated in FIG. 2 are a vertical sync signal, a horizontal sync signal, a data enable signal, and data. Moreover, interrupts A-Z are shown at different points in time along the y-axis. Update of display 116 may occur when vertical sync is logically high. Interrupts A-Z are a more detailed view of timing and operations that occur when vertical sync is logically high for a number of lines to be output to display 116.

In particular, FIG. 2 illustrates deadlines by which decoding must be performed when graphics driver circuit 108 is switched from using a main frame buffer such as buffer 112 to an encoded frame buffer such as buffer 114.

At interrupt A, DMA engine 120 may signal to graphics driver circuit 108 that the last data line of a vertical sync interval has been completed by DMA. The address of a first decoded line may be loaded into a DMA data line source register. This address may later be transmitted on the data line illustrated in FIG. 2.

After interrupt A, the horizontal sync signal may go to logic low, and then again to logic high. The period wherein the horizontal sync signal is logic low may correspond to a horizontal sync interval. After an interval caused by the back porch, interrupt B may be generated. DMA engine 120 may signal to graphics driver circuit 108 that a back porch DMA transfer has been completed. Graphics driver circuit 108 may be configured to begin decoding the data for a second line (denoted as $2^{nd}$ Line in the data line) to be displayed. This decoding must be completed before interrupt C is generated. During this interval, data may be issued from the data line and may be visible (denoted as First Line in the data line). Data enable may be asserted during this interval.

At interrupt C, the data line transfer may be complete. The data enable may be de-asserted. Moreover, the horizontal sync may be de-asserted. The address for a second decoded line may be loaded into a DMA data line source register. After completion of the data line transfer at interrupt C and before the horizontal sync signal goes low again (discussed below), the front porch interval may be performed.

After interrupt C, the horizontal sync signal may go to logic low, and then again to logic high. This period, wherein the horizontal sync signal is logic low, may be another instance of the horizontal sync interval. After the horizontal sync signal goes logic high, and after the back porch DMA transfer has been completed, interrupt D may be generated. DMA engine 120 may then signal to graphics driver circuit 108 that a back porch DMA transfer has been completed for the data whose address was previously loaded (that is, First Line). Graphics driver circuit 108 may be configured to begin decoding the data for a third line to be displayed (denoted as $3^{rd}$ Line in the data line). This decoding must be completed before interrupt E is generated. Interrupt E may be generated upon the end of the visible interval of the second cycle. During this interval, data may be issued from the data line as visible information. Data enable may be asserted during this interval.

In one embodiment, the DMA that transfers the visible data beginning at interrupt B must be established such that, for a first line of data, sufficient time exists between interrupt Z (of a previous cycle) to interrupt A to decode the associated data for the first line. At interrupt B, the first line of data is committed, and the buffer contents are not changed. The time between interrupt B and interrupt D may allow decoding into separate buffers. At interrupt C, the buffer that is feeding the DMA may be freed up and can be used to decode additional information.

Similar operations may be performed for subsequent lines as shown in FIG. 2. After the last line to be displayed on display 116 is shown, interrupt Z may be generated. Afterwards, a vertical sync interval may begin again wherein the vertical sync is de-asserted.

Returning to FIG. 1, system 100 may provide double buffering visual performance without having to use the memory typically needed for double buffering. While less memory is required, there may be greater processing time needed for decoding buffers.

The ability to perform the encoding and decoding solution available in system 100 may be selectively engaged. If sufficient memory is available for full frames in buffers 112, 114 to be used, encoding data might be selectively turned off. Based on available memory, system settings, user settings or preferences, software instructions, quality of display output, or user input, the encoding and decoding may be turned on or off.

Figure 3:
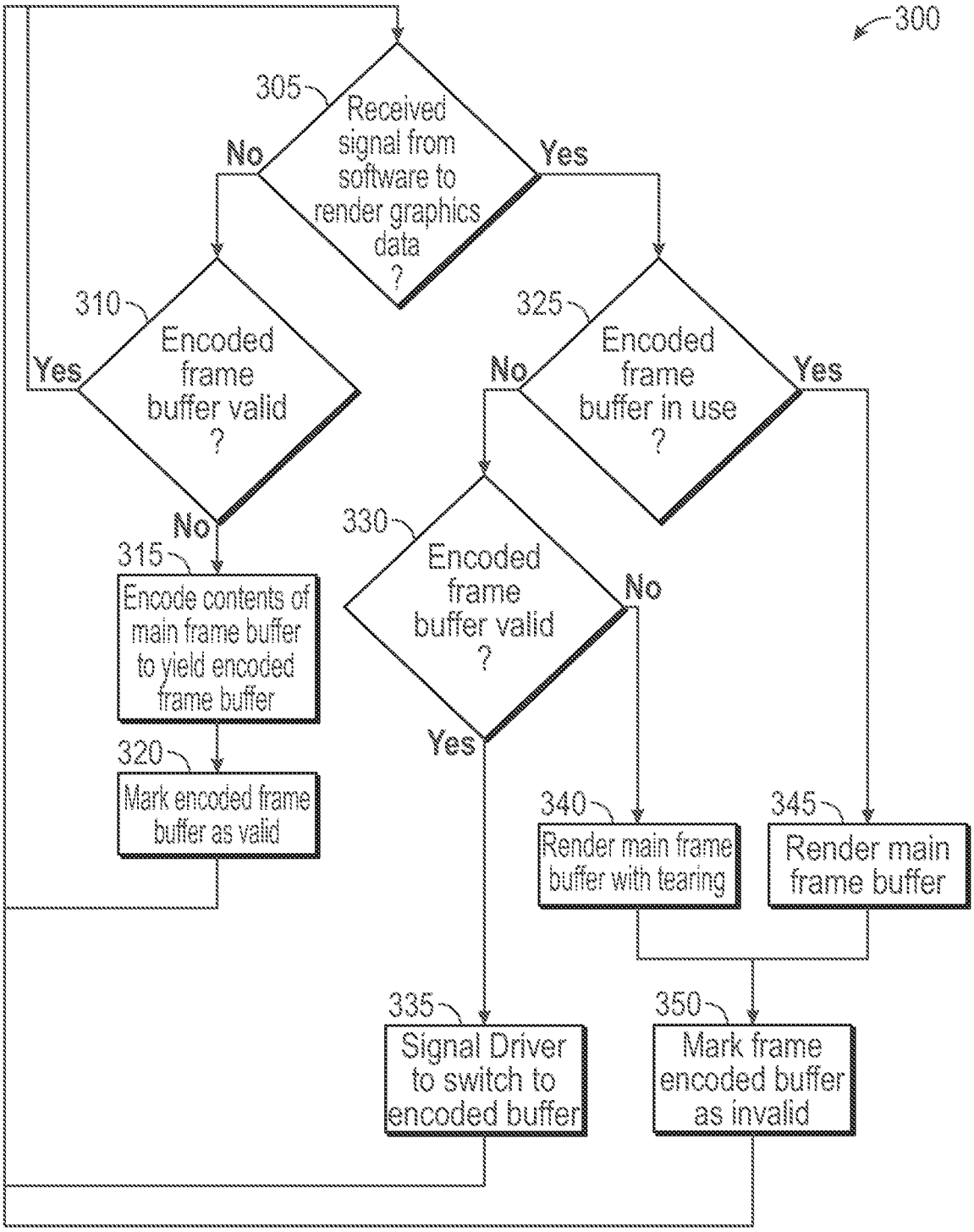
FIG. 3 is an illustration of operation of a graphics engine through a method, according to embodiments of the present disclosure.

FIG. 3 is an illustration of operation of a graphics engine by a method 300, according to embodiments of the present disclosure. For example, FIG. 3 may illustrate operation by graphics engine circuit 106. The operations of method 300 may be performed in parallel with operations of a graphics driver, such as graphics driver circuit 108, illustrated as method 400 in FIG. 4, discussed in further detail below. The steps of method 300 may be optionally repeated, omitted, performed recursively, and may be performed in any suitable manner. Method 300 may include more or fewer steps than are shown in FIG. 3.

At step 305, it may be determined whether an update signal from software 118 has been received at graphics engine circuit 106. The update signal may indicate that software 118 has new data for display on display 116. If so, method 300 may proceed to step 325. If not, method 300 may proceed to step 310.

At step 310, it may be determined whether the encoded frame buffer, such as buffer 114, is valid. Whether a given buffer is valid may be set by graphics engine circuit 106 at different times as shown in the remainder of FIG. 3. A "valid" buffer is a buffer that includes information that is ready to be displayed to display 116 (in some cases, after decoding). An "invalid" is a buffer that does not include information ready to be displayed to display 116. By default, or initially for method 300, the encoded frame buffer might not be set as valid. The valid or invalid status of the encoded frame buffer may have been set by prior execution of method 300 of step 320 or step 350.

If the encoded frame buffer is not valid, method 300 may proceed to step 315 wherein the encoded frame buffer may be populated so that it might be validated. If the encoded frame buffer is valid, method 300 may return to step 305, as no further work is presently to be performed.

At step 315, contents of a main frame buffer, such as buffer 112, may be encoded by graphics engine circuit 106. The encoded contents may be placed into buffer 114, the encoded frame buffer. At step 320, the encoded frame buffer may be marked as valid. Consequently, the contents of buffer 114 may be available for use by graphics driver circuit 108. Method 300 may return to step 305.

At step 325, wherein a signal has been received from software 118 that new data is to be displayed on display 116, it may be determined whether an encoded frame buffer, such as buffer 114, is already in use to display content on display 116. This may arise from previous execution of method 300, and in particular, step 335, wherein graphics engine circuit 106 instructed graphics driver circuit 108 to switch from using the main frame buffer (such as buffer 112) to using the encoded frame buffer (such as buffer 114). Thus, step 325 may determine whether the main frame buffer is unused by graphics driver circuit 108 and might be safely updated while graphics driver circuit 108 is using the encoded frame buffer to display content on display 116. If the encoded frame buffer, such as buffer 114, is already in use to display content on display 116 and the main frame buffer, such as buffer 112, is unused, then method 300 may proceed to step 345. Otherwise, method 300 may proceed to step 330.

At step 330, it may be determined whether the encoded frame buffer, such as buffer 114, is valid. This status may have been set by a prior execution of method 300 of step 320 or step 350. If the encoded frame buffer is valid, method 300 may proceed to step 335. Otherwise, method 300 may proceed to step 340.

At step 335, graphics engine circuit 106 may signal to graphics driver circuit 108 to switch to use of the encoded frame buffer, such as buffer 114. Graphics driver circuit 108 may subsequently being decoding data from buffer 114 and displaying it on display 116, as opposed to loading data from buffer 112 and displaying it on display 116. Method 300 may return to step 305.

At step 340, the encoded frame buffer, such as buffer 114, does not have valid information to be displayed. Thus, the new data, as loaded in the main frame buffer (such as buffer 112), may be displayed to display 116. This may be less than ideal, as the data is both written to and read from the main frame buffer, which may lead to graphical distortions such as tearing. However, graphics engine circuit 106 may nonetheless signal to graphics driver circuit 108 to display data from the main frame buffer as it is rendered by graphics engine circuit 106, as this is the only place from where valid data is available. Method 300 may proceed to step 350.

At step 345, it may have been determined at step 340 that the encoded frame buffer, such as buffer 114, may be in use while the main frame buffer, such as buffer 112, is unused. Thus, at step 345, the main frame buffer may be available to receive newly rendered data. The data produced by software 118 may be rendered into the main frame buffer. Method 300 may proceed to step 350.

At step 350, graphics engine circuit 306 may mark the encoded frame buffer such as buffer 114, as invalid. Thus, subsequently buffer 114 will not be used by graphics driver circuit 308 to display data to display 116 until buffer 114 is again marked as valid.

Method 300 may return to step 305, or may optionally terminate.

Figure 4:
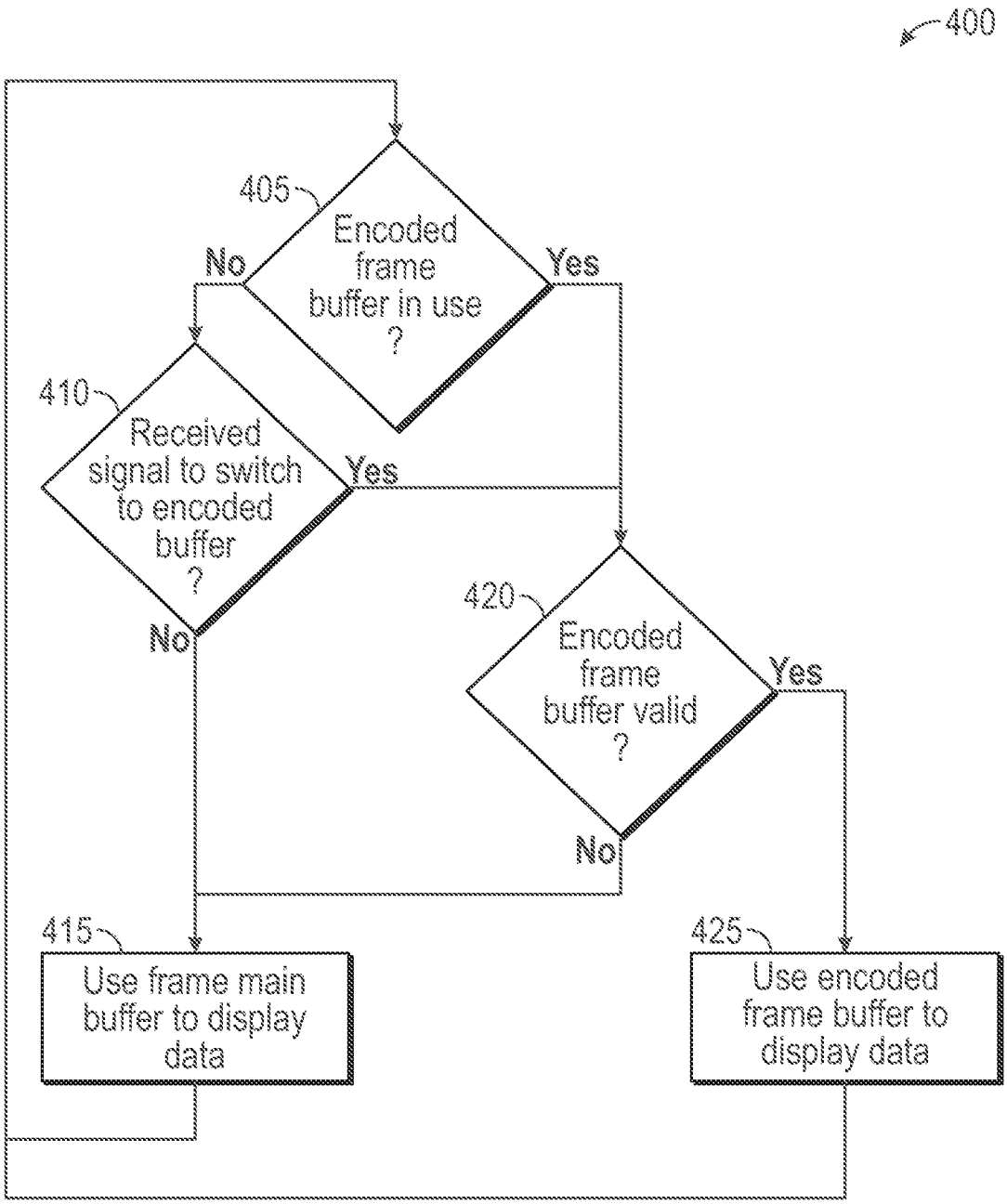
FIG. 4 is an illustration of operation of a graphics driver through a method, according to embodiments of the present disclosure.

FIG. 4 is an illustration of operation of a graphics driver by a method 400, according to embodiments of the present disclosure. For example, FIG. 4 may illustrate operation by graphics driver circuit 108. The operations of method 400 may be performed in parallel with operations of a graphics engine, such as graphics engine circuit 106, illustrated as method 300 in FIG. 3, discussed in further detail above. The steps of method 400 may be optionally repeated, omitted, performed recursively, and may be performed in any suitable manner. Method 400 may include more or fewer steps than are shown in FIG. 4.

At step 405, it may be determined whether graphics driver circuit 108 is currently using an encoded frame buffer, such as buffer 114, to display content to display 116. If not, method 400 may proceed to step 410. Otherwise, method 400 may proceed to step 420.

At step 410, it may be determined whether graphics driver circuit 108 has received a signal from graphics engine circuit 106 to switch from reading data from a main frame buffer (such as buffer 112) to reading data from an encoded frame buffer (such as buffer 114) to display data to display 116. This signal may have been sent by graphics engine circuit 106 in, for example, step 335 of FIG. 3. If so, method 400 may proceed to step 420. If not, method 400 may proceed to step 415.

At step 415, graphics driver circuit 108 may be set to read data from the main frame buffer (such as buffer 112) for displaying data to display 116. Graphics driver circuit 108 may accordingly read such data and display data to display 116. Method 400 may return to step 405.

At step 420, graphics driver circuit 108 may determine whether an encoded frame buffer (such as buffer 114) has been marked as valid, wherein graphics engine circuit 106 has indicated that the encoded frame buffer is to be used rather than a main frame buffer (such as buffer 112). Such a marking may have occurred in, for example, steps 320 or 350 of FIG. 3. If the encoded frame buffer has been marked as valid, method 400 may proceed to step 425. Otherwise, method 400 may proceed to step 415.

At step 425, graphics driver circuit 108 may be set to read data from the encoded frame buffer (such as buffer 114) for displaying data to display 116. Graphics driver circuit 108 may accordingly read such data and display data to display 116. Method 400 may return to step 405.

Although example embodiments have been described above, other variations and embodiments may be made from this disclosure without departing from the spirit and scope of these embodiments.

What is claimed is:

1. An apparatus, comprising:

a graphics engine circuit to:

determine first graphics data to be output to a display;

render the first graphics data to a first buffer; and a graphics driver circuit to:

output the first buffer to the display;

wherein:

the graphics engine circuit is to:

while the graphics driver circuit is outputting the first buffer to the display, encode the first graphics data into a second buffer;

signal the graphics driver circuit to output the second buffer to the display;

determine second graphics data to be output to the display;

determine whether the second buffer is in use by the graphics driver circuit;

based on a determination that the second buffer is not in use by the graphics driver circuit, determine whether contents of the second buffer are signaled by the graphics engine circuit as valid; and based on a determination that contents of the second buffer are not signaled as valid, render the first graphics data to the second buffer with tearing.

2. The apparatus of claim 1, wherein the graphics driver circuit is to, upon reception of a signal from the graphics engine circuit to output the second buffer to the display:

cease output of contents of the first buffer to the display;

decode contents of the second buffer; and output decoded contents of the second buffer to the display.

3. The apparatus of claim 1, wherein the graphics driver circuit is to:

determine that the second buffer is in use to output contents to the display;

based on the determination that the second buffer is in use to output contents to the display, determine that a signal has been received to indicate that the contents of the second buffer are not to be used; and based on the determination that the signal has been received to indicate that contents of the second buffer are not to be used, output the first buffer to the display.

4. The apparatus of claim 1, wherein the graphics driver circuit is to:

upon reception of a signal from the graphics engine circuit to output the second buffer to the display, determine whether the second buffer includes valid data; and based on a determination that the second buffer does not include valid data, continue to output the first buffer to the display.

5. The apparatus of claim 1, wherein the graphics engine circuit is to:

determine second graphics data to be output to the display;

determine whether the second buffer is in use by the graphics driver circuit; and based on a determination that the second buffer is in use by the graphics driver circuit, render the second graphics data to the first buffer.

6. The apparatus of claim 5, wherein the graphics engine circuit is to, after rendering the second graphics data to the first buffer, signal that contents of the second buffer are invalid.

7. The apparatus of claim 1, wherein the graphics engine circuit is to, based on a determination that contents of the second buffer are signaled as valid, signal to the graphics driver circuit to output the second buffer to the display.

8. The apparatus of claim 1, wherein the graphics engine circuit is to signal that contents of the second buffer are invalid.

9. A method, comprising, at a graphics engine circuit:

determining first graphics data to be output to a display;

rendering the first graphics data to a first buffer;

while a graphics driver circuit is outputting the first buffer to the display, encoding the first graphics data into a second buffer;

signaling the graphics driver circuit to output the second buffer to the display;

determining second graphics data to be output to the display;

determining whether the second buffer is in use by the graphics driver circuit; and based on a determination that the second buffer is not in use by the graphics driver circuit, determining whether contents of the second buffer are signaled by the graphics engine circuit as valid; and at the graphics engine circuit, based on a determination that contents of the second buffer are not signaled as valid, rendering the first graphics data to the second buffer with tearing.

10. The method of claim 9, comprising, at the graphics driver circuit and upon reception of a signal from the graphics engine circuit to output the second buffer to the display:

ceasing output of contents of the first buffer to the display;

decoding contents of the second buffer; and outputting decoded contents of the second buffer to the display.

11. The method of claim 9, comprising, at the graphics driver circuit:

determining that the second buffer is in use to output contents to the display;

based on the determination that the second buffer is in use to output contents to the display, determining that a signal has been received to indicate that the contents of the second buffer are not to be used; and based on the determination that the signal has been received to indicate that contents of the second buffer are not to be used, outputting the first buffer to the display.

12. The method of claim 9, comprising, at the graphics driver circuit:

upon reception of a signal from the graphics engine circuit to output the second buffer to the display, determining whether the second buffer includes valid data; and based on a determination that the second buffer does not include valid data, continuing to output the first buffer to the display.

13. The method of claim 9, comprising, at the graphics engine circuit:

determining second graphics data to be output to the display;

determining whether the second buffer is in use by the graphics driver circuit; and based on a determination that the second buffer is in use by the graphics driver circuit, rendering the second graphics data to the first buffer.

14. The method of claim 13, comprising, at the graphics engine circuit, after rendering the second graphics data to the first buffer, signaling that the contents of the second buffer are invalid.

15. The method of claim 9, comprising, at the graphics engine circuit, based on a determination that contents of the second buffer are signaled as valid, signaling to the graphics driver circuit to output the second buffer to the display.

16. The method of claim 9, comprising, at the graphics engine circuit, signaling that the contents of the second buffer are invalid.

* * * * *